US007506971B2

(12) United States Patent
Lewey et al.

(10) Patent No.: US 7,506,971 B2
(45) Date of Patent: Mar. 24, 2009

(54) FLUID DELIVERY SYSTEM FOR PRINTING DEVICE

(75) Inventors: William E Lewey, Corvallis, OR (US); Kevin D. Almen, Corvallis, OR (US); David N. Olsen, Corvallis, OR (US); Steven N Miller, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 503 days.

(21) Appl. No.: 11/261,681

(22) Filed: Oct. 28, 2005

(65) Prior Publication Data

US 2007/0097187 A1 May 3, 2007

(51) Int. Cl.
*B41J 2/17* (2006.01)
*B41J 2/175* (2006.01)

(52) U.S. Cl. ..... 347/85; 347/84

(58) Field of Classification Search ..... 347/6, 347/84–87

See application file for complete search history.

(56) References Cited

U.S. PATENT DOCUMENTS

| | | | | |
|---|---|---|---|---|
| 6,609,780 | B2 | 8/2003 | Sugiyama | |
| 2004/0061747 | A1 | 4/2004 | Nakao | |
| 2004/0218026 | A1 | 11/2004 | Matsushita | |
| 2005/0156965 | A1* | 7/2005 | Hoshino | 347/9 |
| 2005/0168540 | A1 | 8/2005 | Wilson et al. | |

FOREIGN PATENT DOCUMENTS

| | | |
|---|---|---|
| CN | 1600550 | 3/2005 |
| EP | 0598481 | 5/1994 |
| EP | 1287999 | 3/2003 |
| EP | 1502749 | 2/2005 |
| GB | 2400820 | 10/2004 |
| JP | 06155756 | 6/1994 |
| JP | 07081084 | 3/1995 |
| JP | 07096609 | 4/1995 |
| JP | 08192519 | 7/1996 |
| JP | 2003001843 | 1/2003 |

OTHER PUBLICATIONS

International Search Report for Application No. PCT/US2006/029497. Report issued Dec. 20, 2006.

* cited by examiner

*Primary Examiner*—Julian D Huffman
*Assistant Examiner*—Jason S Uhlenhake

(57) ABSTRACT

An apparatus for use in a fluid delivery system includes a housing configurable to separate a first volume of gas from a second volume of gas and an interface arranged within the housing. The interface includes a bubbler member that is fluidically wetted with a fluid via capillary action. The interface is configured to allow a gas from the first volume of gas to pass through the fluid into the second volume of gas when a pressure difference between the first and second volumes of gas reaches a first threshold level. The interface is also configured to allow a gas from the second volume of gas to pass through the fluid into the first volume of gas when the pressure difference between the first and second volumes of gas reaches a second threshold level.

24 Claims, 7 Drawing Sheets

FLUID DELIVERY SYSTEM FOR PRINTING DEVICE

RELATED PATENT APPLICATIONS

This patent application is related to U.S. patent application Ser. No. 11/262,196, titled "Printing Fluid Control In Printing Device", filed Oct. 28, 2005.

This patent application is related to U.S. patent application Ser. No. 11/261,680, titled "Free Flow Fluid Delivery System For Printing Device", filed Oct. 28, 2005.

This patent application is related to U.S. patent application Ser. No. 11/261,679, titled "Free Flow Fluid Delivery System Methods", filed Oct. 28, 2005.

BACKGROUND

Some printing devices include a printhead or pen that is configured to controllably direct drops of ink(s) or other printing fluid(s) towards a sheet of paper or other like print medium. The inks or printing fluids are typically supplied by to the printhead by a fluid delivery system. Some fluid delivery systems are located "on-axis" with the printhead while others also include "off-axis" components. The fluid delivery system may include, for example, one or more containers that act as reservoirs to supply the fluids to the printhead through one or more fluidic channels.

In certain printing devices, the fluid delivery system is configured to maintain a backpressure force on the printing fluid so as to prevent the printing fluid from simply draining out through the ejection nozzles of the printhead. Accordingly, as the printing fluid is ejected during printing the fluid delivery system is usually configured to adapt to the reduced volume of printing fluid in some manner so as to maintain the backpressure force within applicable limits. For example, some fluid delivery systems include foam or other like capillary members within an on-axis container. The foam acts like a sponge in holding the printing fluid while also allowing the fluid to be used for printing. The capillary action of the foam provides the backpressure force. As the printing fluid is consumed air is allowed to enter into the container and into the foam.

In other exemplary printing devices, the printing fluid is delivered from on-axis and/or off-axis containers that do not include foam. Some of these containers include a bag-accumulator arrangement or the like that provides the desired backpressure force. Some of these containers include a bubbler feature that is configured to allow air to bubble into the container through the printing fluid to maintain the desired backpressure force. Some off-axis implementations also include additional containers adjacent the printhead.

In some implementations, a pump may also be provided to move the printing fluid in one or both directions between the container and the printhead. However, the movement of fluid and air into and out of a container may lead to the formation of froth, which can reduce the effectiveness of the fluid delivery system and possibly affect printing. Further, the movement of air into the container may affect the backpressure force.

Accordingly, there is a need for a fluid delivery system that reduces the formation of froth and/or allows that maintains a desired backpressure as fluid and/or air (or other gas) enters and/or exits the container.

BRIEF DESCRIPTION OF THE DRAWINGS

The following detailed description refers to the accompanying figures.

DETAILED DESCRIPTION

Figure 1:
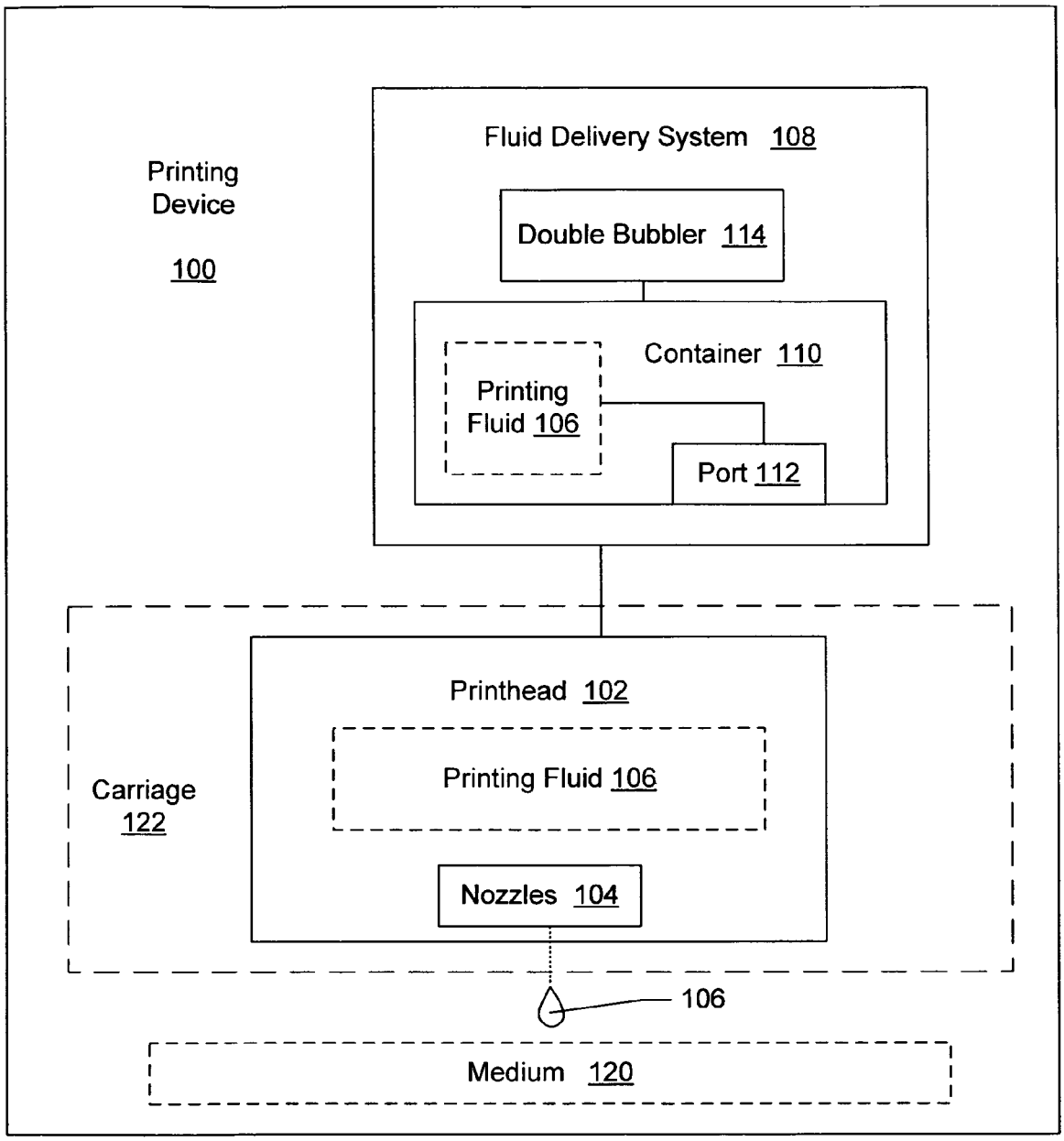
FIG. 1 is a block diagram illustrating certain features of a printing device including a fluid delivery system having a container and a bi-directional "double bubbler", in accordance with certain exemplary implementations.

FIG. 1 is a block diagram of an exemplary printing device 100 having a printhead 102 with a plurality of nozzles 104 for forming an image on a print medium 120 using selectively ejected droplets of at least one printing fluid 106. Printing fluid 106 is supplied to printhead 102 by a printing fluid delivery system 108 that includes a supply of printing fluid 106 in a container 110. Printhead 102 may be arranged "on-axis" with regard to the printing process by way of a moving carriage 122 or the like. Container 110 may be arranged "off-axis" and operatively coupled to printhead 102 through one or more fluidic couplings (not shown) such as, for example, channels, tubes, pipes, fittings, etc. Container 110 includes a printing fluid port 112 through which printing fluid 106 exits container 110. In certain implementations, printing fluid 106 and/or gas may also enter into container 110 through printing fluid port 112.

A double bubbler 114, in accordance with certain exemplary aspects of the present embodiment, is also included in printing fluid delivery system 108 to regulate gas pressure within container 110, for example, based on the gas pressure of the atmosphere outside of container 110. Double bubbler 114 is bi-directional in that it is configured to allow gas within container 110 to escape into the atmosphere and to allow gas from the atmosphere to enter into container 110 based on a pressure difference between the gas in the container and gas in the atmosphere. Thus, for example, when the absolute value or magnitude of the pressure difference reaches a threshold level then double bubbler 114 will permit gas to enter or exit container 110, flowing or bubbling from the higher pressure side to the lower pressure side.

In FIG. 1, the exemplary printing fluid delivery system 108 may supply printing fluid 106 to printhead 102 using gravity and/or the ejecting action of nozzles 104 to urge printing fluid 106 from container 110 through printing fluid port 112.

Figure 2A:
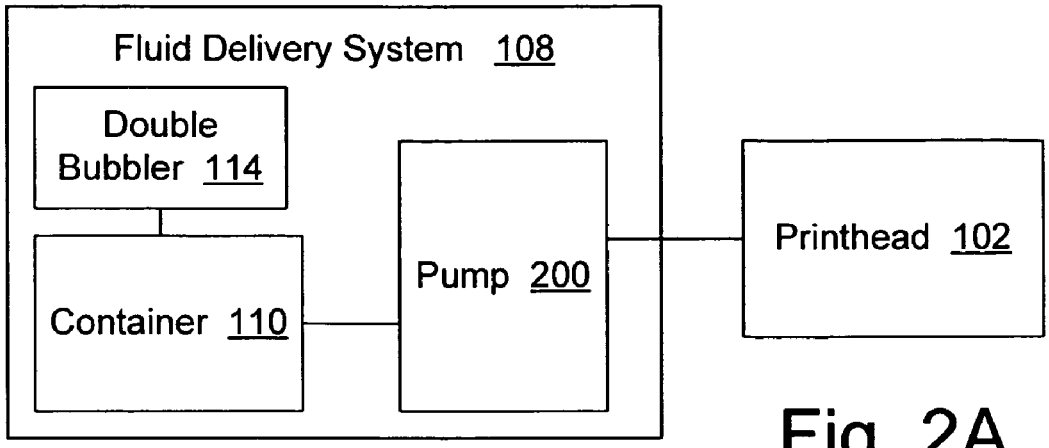
FIGS. 2A-C are block diagrams illustrating some alternatively arranged fluid delivery systems having a container and a bi-directional "double bubbler", in accordance with certain further exemplary implementations.
Figure 2B:
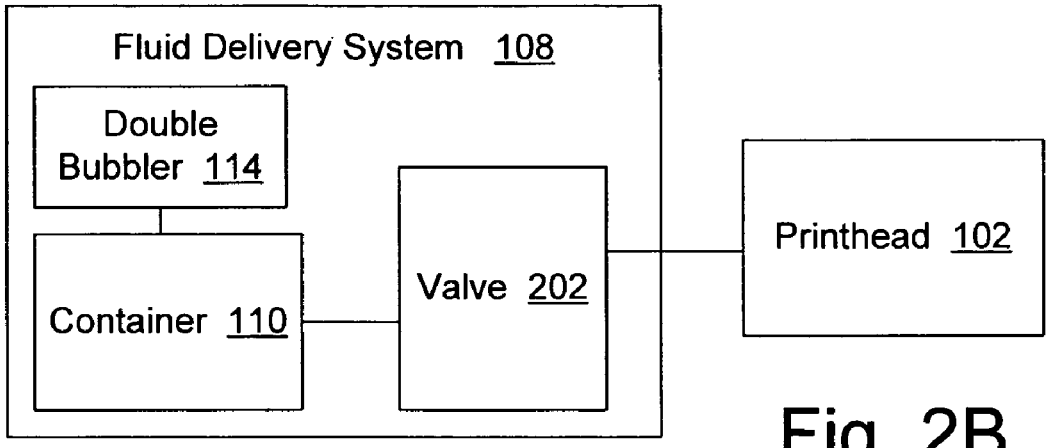
Figure 2C:
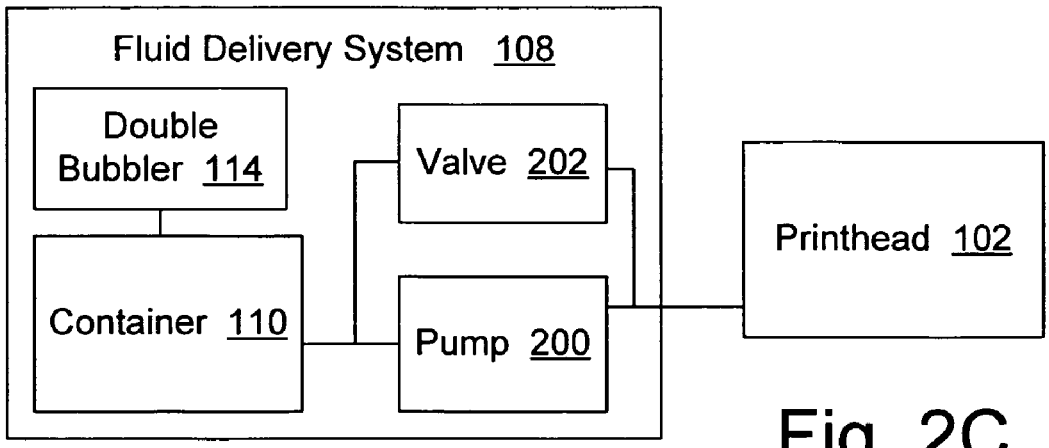

In FIGS. 2A-C, which are block diagrams depicting some other exemplary similar printing devices, additional mechanisms are provided in the path from container 110 to printhead 102 in accordance with certain further aspects of the present description.

In FIG. 2A, a pump 200 is provided between container 110 and printhead 102 to controllably urge printing fluid 106 in one or both directions there between. Thus, pump 200 may unidirectional or bi-directional. In FIG. 2B, a valve 202 is provided between container 110 and printhead 102 to selectively halt printing fluid 106 from flowing there between. In FIG. 2C, pump 200 and valve 202 are provided between container 110 and printhead 102. In this configuration, valve 202 is in a bypass position with regard to pump 200, such that printing fluid 106 may flow between container 110 and printhead 102 without being urged by pump 200 when valve 202 is open.

In certain implementations, valve 202 is a normally closed valve that can be selectively opened or otherwise activated. For example, valve 102 may be configured to open only when adequate electrical power is available to printing device 100 to prevent potential leaking of printing fluid 106 out of nozzles 104 when electrical power is unavailable to the printing device (e.g., a power switch is turned off, the printing device is unplugged, electrical power is out, etc.). In certain implementations, for example, valve 202 may include a solenoid or other electrically activated switching mechanism that closes when power is unavailable.

Figure 3A:
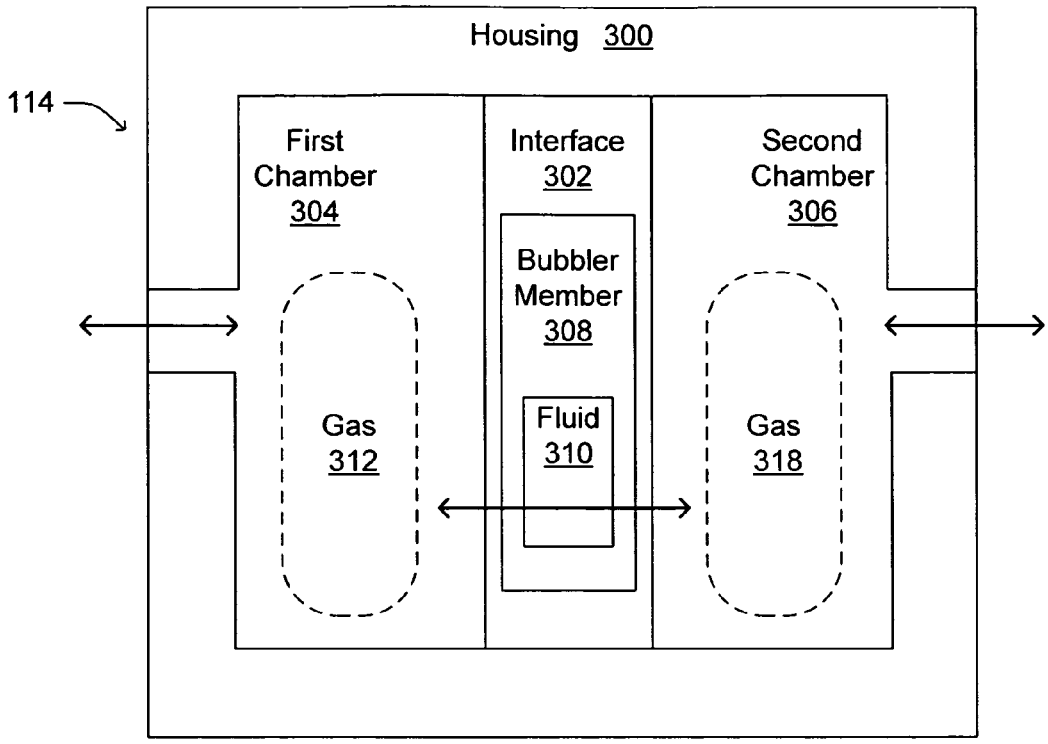
FIGS. 3A-B are block diagrams illustrating certain features of some exemplary bi-directional double bubblers having bubbler members, in accordance with certain exemplary implementations.

FIG. 3A is a block diagram further illustrating certain exemplary features of double bubbler 114.

In this example, double bubbler 114 includes a housing 300 within which are arranged an interface 302, a first chamber 304 and a second chamber 306. Interface 302 includes a bubbler member 308 that is at least partially wetted or otherwise brought into contact with a fluid 310 through capillary action. Fluid 310 may include oil or the like. For example, in certain implementations fluid 310 includes a mineral oil. Consequently, interface 302 and fluid 310 at bubbler member 308 form a separating barrier between gas in first chamber 304 and gas in second chamber 306. This separating barrier, however, is designed to be permeable by gas when a pressure difference between gas in first chamber 304 and gas in second chamber 306 reaches a threshold level. When the threshold level is reached gas from the higher pressure chamber will displace or otherwise move some of fluid 310 so as to pass through fluid 310 into the lower pressure chamber (e.g., as small bubbles) until the pressure difference falls below the threshold level.

In FIG. 3A, first chamber 304 is illustrated as having a first type of gas 312 which is at least a part of a first volume of gas having a first pressure. Similarly, second chamber 306 is illustrated as having a second type of gas 318 which is at least a part of a second volume of gas having a second pressure. In certain implementations, first and second types of gas are the same types of gas. In other implementations, the first and second types of gas may include different types of gas. As used herein, the term gas means one or more gases.

In certain exemplary implementations, a pressure difference may be calculated as the absolute value of the difference between the first pressure and the second pressure as exerted on fluid 310 at bubbler member 308. In certain implementations, there is may be a common threshold level. In other implementations, the design of bubbler member 308 may be such that there is a unique threshold level associated with each chamber or volume of gas. For example, bubbler member 308 may be configured such that it presents a different geometric shape in each chamber or to each volume of gas such that the resulting contact angle, surface area, and/or surface tension of fluid 310 wetting bubbler member 308 leads to different threshold levels.

Figure 3B:
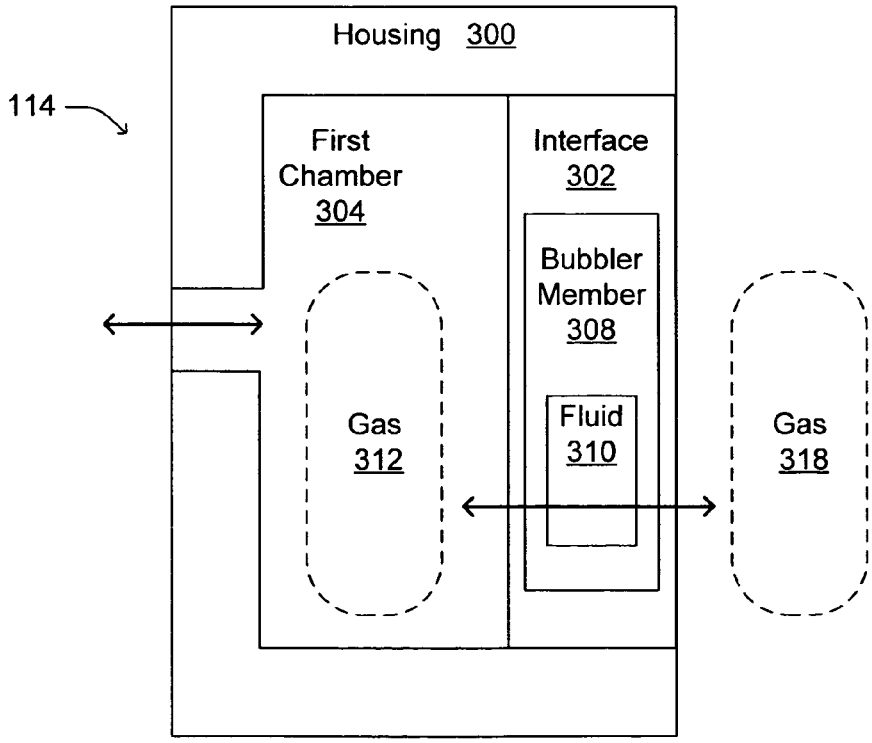

FIG. 3B, which is similar to FIG. 3A, illustrates another exemplary double bubbler 114 in which there is only one chamber within housing 300 such that interface 302 has one side open to the atmosphere shown here as gas 318.

FIGS. 4A-D are diagrams illustrating, in cross-sectional view, an exemplary double bubbler 400 having bubbler member 308 that forms a gap opening 406 that is wetted by a fluid 310 (FIGS. 4B-D) through which gas bubbles 410 may pass, in accordance with certain exemplary implementations.

Figure 4A:
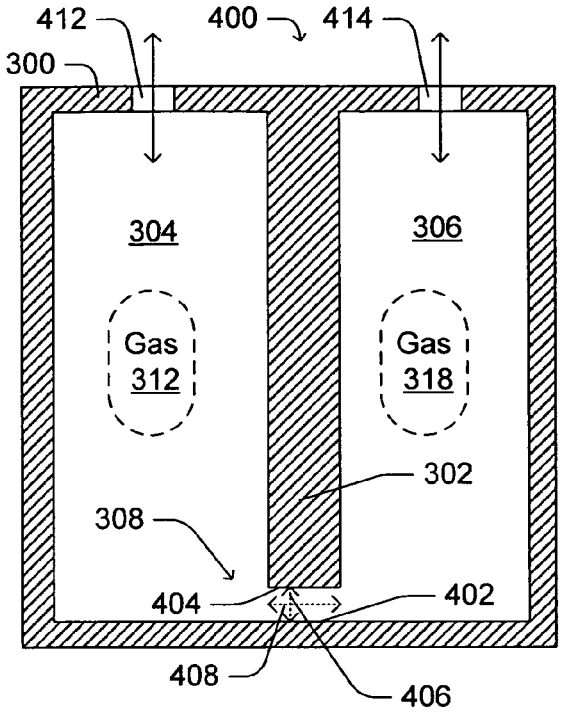
FIGS. 4A-D are diagrams illustrating, in cross-sectional view, an exemplary double bubbler having a bubbler member that forms a gap opening that is wetted by a fluid through which gas bubbles may pass, in accordance with an exemplary implementation.

As shown in FIG. 4A, housing 300 includes first chamber 304 and second chamber 306 with first type of gas 312 and second type of gas 318, respectively. A first opening 412 leads through housing 300 into first chamber 304. A second opening 414 leads through housing 300 into second chamber 306. Interface 302 separates the first and second chambers and includes bubbler member 308. Bubble member 308 includes closely spaced apart opposing surfaces 402 and 404 between which a gap opening 406 is formed having a width 408.

Note that the exemplary drawings are illustrative only and are neither drawn to scale nor intended to reflect any specific proportionality or size.

Figure 4B:
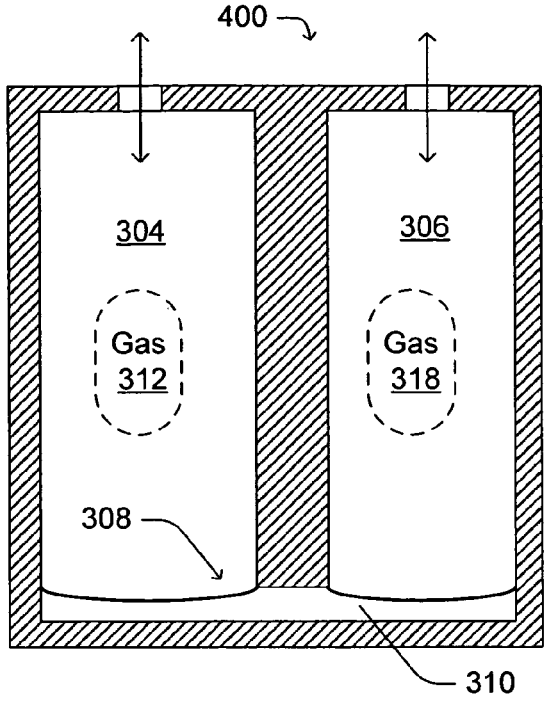

In FIG. 4B, fluid 310 is illustrated as being present within the first and second chambers and gap opening 406. Fluid 310 is drawn into and maintained within gap opening 406 by capillary action. In FIG. 4B, the gas pressure of the first type of gas 312 is approximately the same as the gas pressure of the second type of gas 318 as illustrated by the similar levels of fluid 310 in the first and second chambers.

Figure 4C:
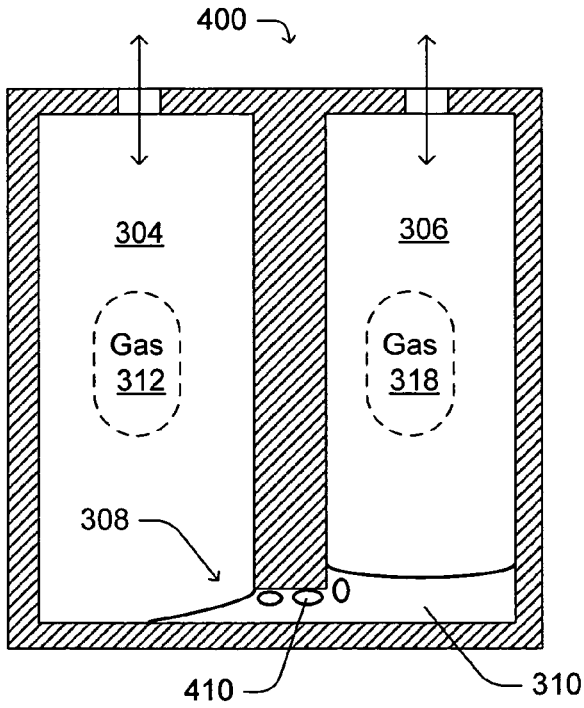

In FIG. 4C, the gas pressure of the first type of gas 312 is greater than the gas pressure of the second type of gas 318 as illustrated by the dissimilar levels of fluid 310 in the first and second chambers. Indeed, as illustrated by the gas bubbles 410 passing through fluid 310 in gap opening 406, the pressure differential has reached a first threshold level and some of the first type of gas 312 is released into the second type of gas 318.

Figure 4D:
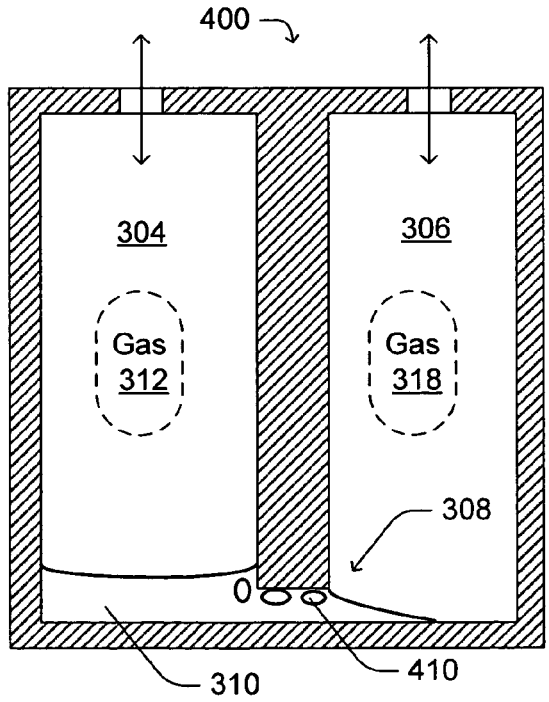

In FIG. 4D, the gas pressure of the second type of gas 318 is greater than the gas pressure of the first type of gas 312 as illustrated by the dissimilar levels of fluid 310 in the first and second chambers. As illustrated by the gas bubbles 410 passing through fluid 310 in gap opening 406, the pressure differential has reached a second threshold level and some of the second type of gas 318 is released into the second type of gas 312.

FIGS. 5A-D are diagrams illustrating, in cross-sectional view, an exemplary double bubbler 500 having a bubbler member 308 that includes an opening 502 with a filter 504 (e.g., a screen) that is wetted by fluid 310 through which gas bubbles 510 may pass, in accordance with certain other exemplary implementations.

Figure 5A:
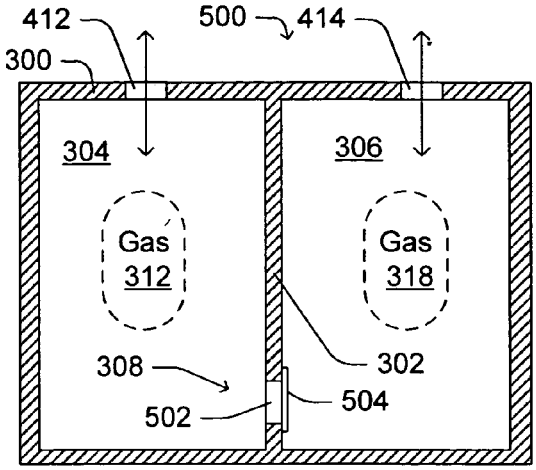
FIGS. 5A-D are diagrams illustrating, in cross-sectional view, an exemplary double bubbler having a bubbler member that includes an opening with a filter or screen that is wetted by a fluid through which gas bubbles may pass, in accordance with certain other exemplary implementations.

As shown in FIG. 5A, housing 300 includes first chamber 304 and second chamber 306 with first type of gas 312 and second type of gas 318, respectively. A first opening 412 leads through housing 300 into first chamber 304. A second opening 414 leads through housing 300 into second chamber 306. Interface 302 separates the first and second chambers and includes bubbler member 308. Bubble member 308 includes opening 502 which is covered by filter 504.

Figure 5B:
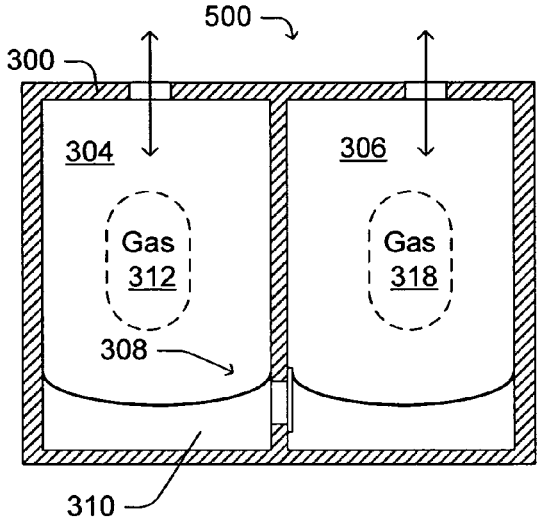

In FIG. 5B, fluid 310 is illustrated as being present within the first and second chambers and opening 502 so as to wet filter 504. Fluid 310 is drawn into and maintained within filter 504 by capillary action. In FIG. 5B, the gas pressure of the first type of gas 312 is approximately the same as the gas pressure of the second type of gas 318 as illustrated by the similar levels of fluid 310 in the first and second chambers.

Figure 5C:
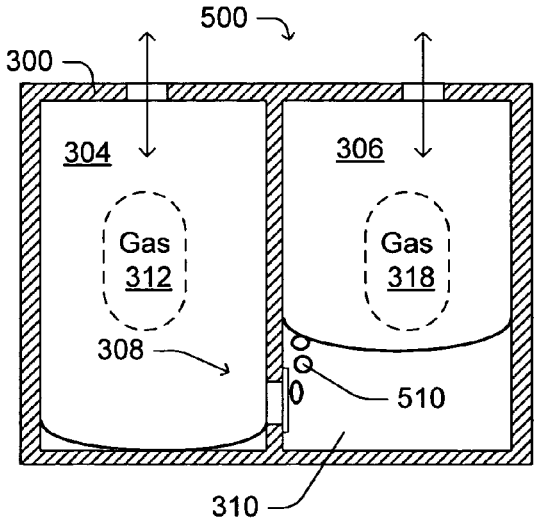

In FIG. 5C, the gas pressure of the first type of gas 312 is greater than the gas pressure of the second type of gas 318 as illustrated by the dissimilar levels of fluid 310 in the first and second chambers. Indeed, as illustrated by the gas bubbles 510 passing through fluid 310 in filter 504, the pressure differential has reached a first threshold level and some of the first type of gas 312 is released into the second type of gas 318.

Figure 5D:
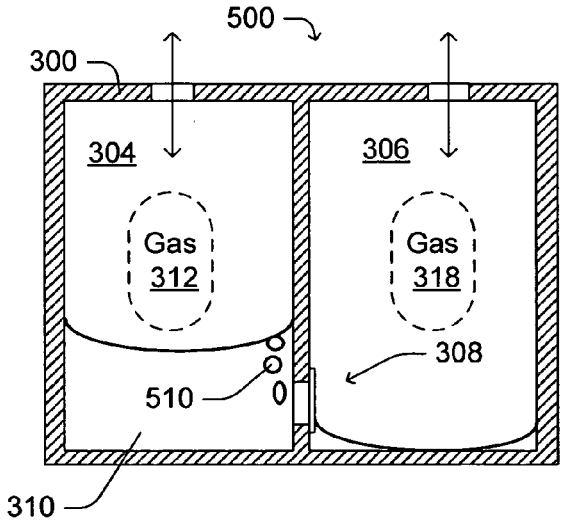

In FIG. 5D, the gas pressure of the second type of gas 318 is greater than the gas pressure of the first type of gas 312 as illustrated by the dissimilar levels of fluid 310 in the first and second chambers. As illustrated by the gas bubbles 510 passing through fluid 310 in filter 504, the pressure differential has reached a second threshold level and some of the second type of gas 318 is released into the second type of gas 312.

FIGS. 6A-D are diagrams illustrating, in cross-sectional view, an exemplary double bubbler 600 having a bubbler member 308 that includes an opening 602 with an edge 604 that contacts a non-planer surface 608 (FIGS. 6B-D) that is wetted by a fluid 310 through which gas bubbles 610 may pass, in accordance with still other exemplary implementations.

Figure 6A:
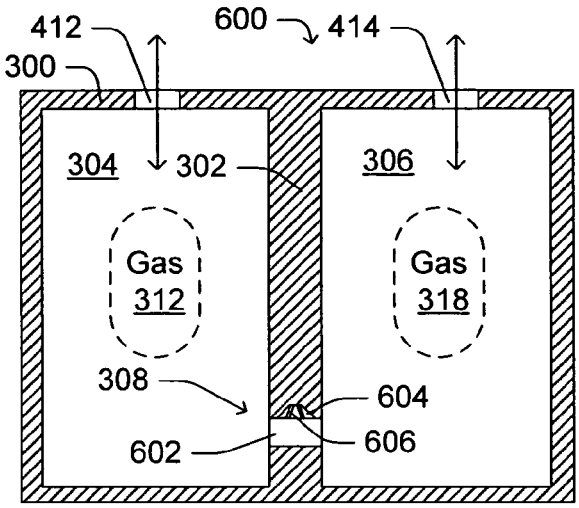
FIGS. 6A-D are diagrams illustrating, in cross-sectional view, an exemplary double bubbler having a bubbler member that includes an opening with a non-planer surface that is wetted by a fluid through which gas bubbles may pass, in accordance with still other exemplary implementations.

As shown in FIG. 6A, housing 300 includes first chamber 304 and second chamber 306 with first type of gas 312 and second type of gas 318, respectively. A first opening 412 leads through housing 300 into first chamber 304. A second opening 414 leads through housing 300 into second chamber 306. Interface 302 separates the first and second chambers and includes bubbler member 308. Bubble member 308 includes opening 602 having edge 604. Edge 604 in this example, is non-uniform in that edge 604 includes at least one groove or channel 606.

Figure 6B:
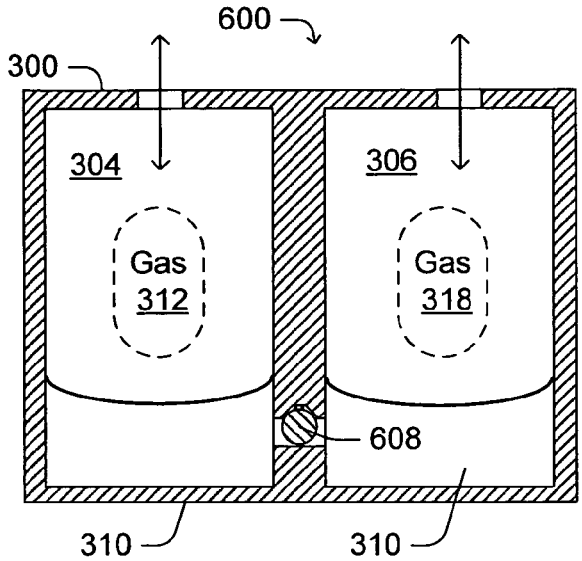

In FIG. 6B, non-planer surface 608 is provided by a captured ball that has been inserted or otherwise provided for in opening 602. In this example, a portion of non-planer surface 608 contacts portions of edge 604 such that channel(s) 606 are at least partially bounded by non-planer surface 608 and fill with fluid 310 through capillary action. In FIG. 6B, the gas pressure of the first type of gas 312 is approximately the same as the gas pressure of the second type of gas 318 as illustrated by the similar levels of fluid 310 in the first and second chambers.

Figure 6C:
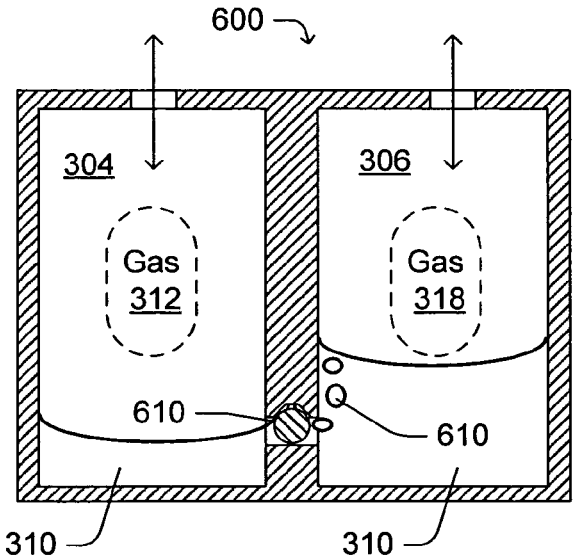

In FIG. 6C, the gas pressure of the first type of gas 312 is greater than the gas pressure of the second type of gas 318 as illustrated by the dissimilar levels of fluid 310 in the first and second chambers. Indeed, as illustrated by the gas bubbles 610 passing through fluid 310 in channel 606, the pressure differential has reached a first threshold level and some of the first type of gas 312 is released into the second type of gas 318.

Figure 6D:
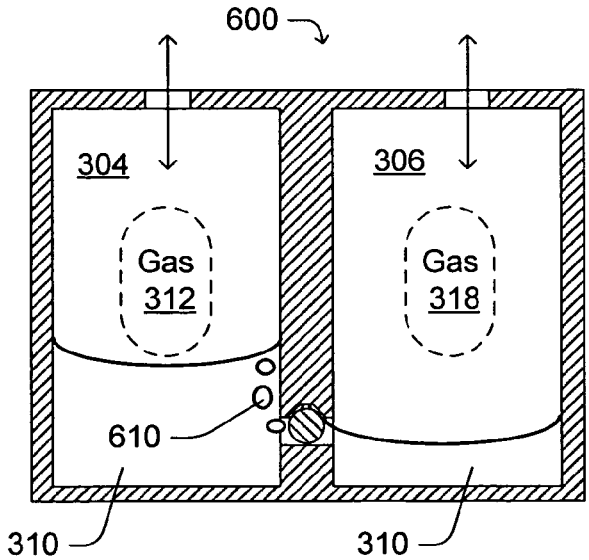

In FIG. 6D, the gas pressure of the second type of gas 318 is greater than the gas pressure of the first type of gas 312 as illustrated by the dissimilar levels of fluid 310 in the first and second chambers. As illustrated by the gas bubbles 610 passing through fluid 310 in channel 606, the pressure differential has reached a second threshold level and some of the second type of gas 318 is released into the second type of gas 312.

FIGS. 7A-E are diagrams illustrating, in cross-sectional view, an exemplary double bubbler 700 having a bubbler member 308 that includes opening 602 with edge 604 that contacts non-planer surface 608 (FIGS. 7B-E) that is wetted via a passageway 702 with fluid 310 through which gas bubbles 710 may pass, in accordance with still other exemplary implementations.

Figure 7A:
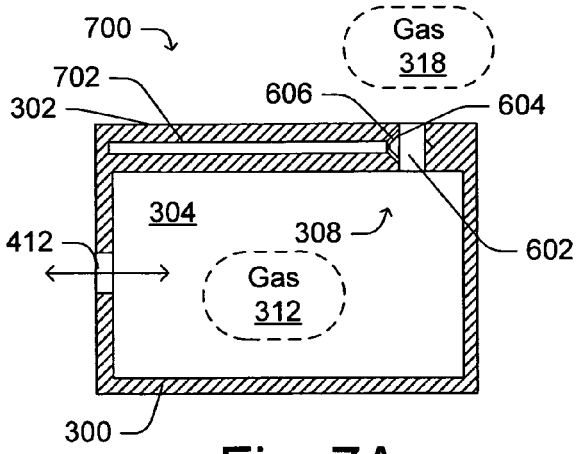
FIGS. 7A-E are diagrams illustrating, in cross-sectional view, an exemplary double bubbler having a bubbler member that includes an opening with a non-planer surface that is wetted via a passageway with a fluid through which gas bubbles may pass, in accordance with still other exemplary implementations.

As shown in FIG. 7A, housing 300 includes first chamber 304 with first type of gas 312. Second type of gas 318 is present in the atmosphere or environment external housing 300. A first opening 412 leads through housing 300 into first chamber 304. Interface 302 separates first chamber 304 from the atmosphere/environment external housing 300 and includes bubbler member 308. Bubble member 308 includes opening 602 having edge 604. Edge 604 in this example, is non-uniform in that edge 604 includes at least one groove or channel 606.

In FIG. 67, non-planer surface 608 is provided by a captured ball that has been inserted or otherwise provided for in opening 602. In this example, a portion of non-planer surface 608 contacts portions of edge 604 such that channel(s) 606 are at least partially bounded by non-planer surface 608 and fill with fluid 310 within passageway 702 through capillary action.

Figure 7B:
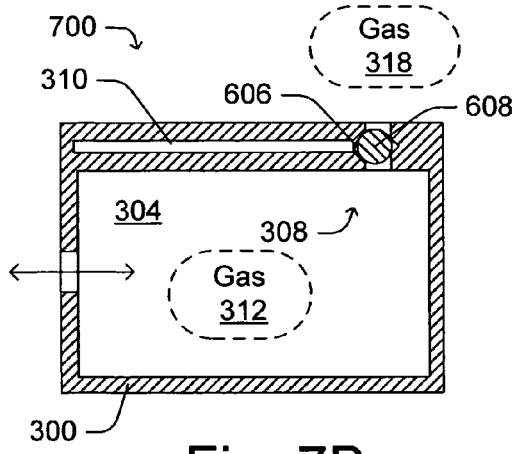
Figure 7C:
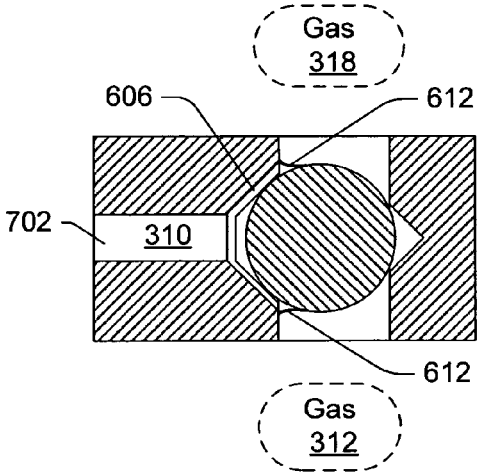

In FIG. 7C, which is a close-up view of bubble member 308, the gas pressure of the first type of gas 312 is approximately the same as the gas pressure of the second type of gas 318 as illustrated by the similarities of fluid 310 forming meniscuses 612 between edge 604 and non-planer surface 608 adjacent each type/volume of gas.

Figure 7D:
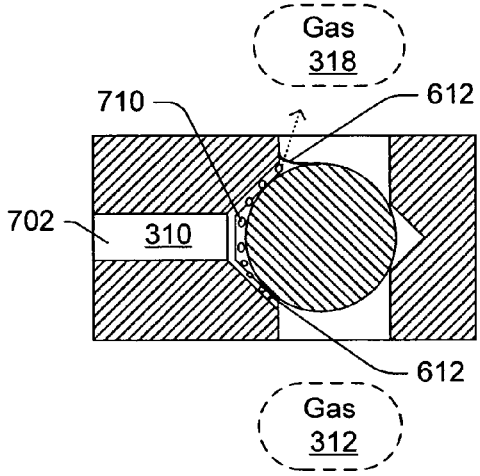

In FIG. 7D, which is similar to FIG. 7C, the gas pressure of the first type of gas 312 is greater than the gas pressure of the second type of gas 318 as illustrated by the dissimilar meniscuses 612 of fluid 310 between edge 604 and non-planer surface 608 adjacent each type/volume of gas. Indeed, as illustrated by the gas bubbles 710 passing through fluid 310 in channel 606, the pressure differential has reached a first threshold level and some of the first type of gas 312 is released into the second type of gas 318.

Figure 7E:
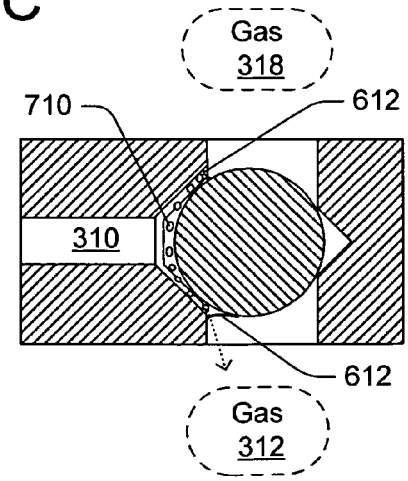

In FIG. 7E, which is similar to FIG. 7C, the gas pressure of the second type of gas 318 is greater than the gas pressure of the first type of gas 312 as illustrated by the dissimilar meniscuses 612 of fluid 310 between edge 604 and non-planer surface 608 adjacent each type/volume of gas. As illustrated by the gas bubbles 710 passing through fluid 310 in channel 606, the pressure differential has reached a second threshold level and some of the second type of gas 318 is released into the second type of gas 312.

Although the above disclosure has been described in language specific to structural/functional features and/or methodological acts, it is to be understood that the appended claims are not limited to the specific features or acts described. Rather, the specific features and acts are exemplary forms of implementing this disclosure.

What is claimed is:

1. An apparatus comprising:

a housing configurable to separate a first volume of gas from a second volume of gas;

an interface arranged within said housing, said interface having a bubbler member that is fluidically wetted with a fluid via capillary action and configured to allow a gas from said first volume of gas to pass through said fluid into said second volume of gas when a pressure difference between said first and second volumes of gas reaches a first threshold level, and also configured to allow a gas from said second volume of gas to pass through said fluid into said first volume of gas when said pressure difference between said first and second volumes of gas reaches a second threshold level, wherein said interface includes an opening and said bubbler member includes a filter covering said opening.

2. The apparatus as recited in claim 1, wherein said housing includes a first chamber and a second chamber, said first chamber being configurable to receive at least a portion of said first volume of gas, and said second chamber being configurable to receive at least a portion of said second volume of gas.

3. The apparatus as recited in claim 2, wherein said fluid is contained within said first and second chambers.

4. The apparatus as recited in claim 2, wherein said bubbler member includes a first surface and a second surface arranged to form a gap opening there between, said gap opening fluidically coupling said first and second chambers.

5. The apparatus as recited in claim 1, wherein said first and second threshold levels are equal in magnitude.

6. The apparatus as recited in claim 1, wherein a type of said gas from said first volume of gas is the same as a type of said gas from said second volume of gas.

7. The apparatus as recited in claim 1, said fluid comprising an oil.

8. The apparatus as recited in claim 1, wherein said apparatus is operatively arranged within a printing device as part of a printing fluid delivery system.

9. An apparatus comprising:

a housing configurable to separate a first volume of gas from a second volume of gas;

an interface arranged within said housing, said interface having a bubbler member that is fluidically wetted with a fluid via capillary action and configured to allow a gas from said first volume of gas to pass through said fluid into said second volume of gas when a pressure difference between said first and second volumes of gas reaches a first threshold level, and also configured to allow a gas from said second volume of gas to pass through said fluid into said first volume of gas when said pressure difference between said first and second volumes of gas reaches a second threshold level, wherein said interface includes an opening with an edge, said bubbler member has a surface opposing said edge, and said fluid forms a meniscus between said edge and said surface, wherein at least a portion of said surface is non-planer.

10. The apparatus as recited in claim 9, wherein said interface includes a passageway being configured to supply said fluid to said edge and said surface.

11. The apparatus as recited in claim 9, wherein said portion of said surface. has a spherical shape.

12. The apparatus as recited in claim 9, wherein said edge is substantially uniform in shape.

13. A printing fluid delivery system within a printing device, comprising:

a housing configurable to separate a first volume of gas from a second volume of gas;

an interface arranged within said housing, said interface having a bubbler member that is fluidically wetted with a fluid via capillary action and configured to allow a gas from said first volume of gas to pass through said fluid into said second volume of gas when a pressure difference between said first and second volumes of gas reaches a first threshold level, and also configured to allow a gas from said second volume of gas to pass through said fluid into said first volume of gas when said pressure difference between said first and second volumes of gas reaches a second threshold level, a container coupled to said housing and configured to hold a printing fluid and at least a portion of said first volume of gas, said container having a printing fluid port configured to allow said printing fluid within said container to exit said container; and a valve fluidically coupled to said printing fluid port and configured to prevent said printing fluid from exiting said container when said printing device is non-operational.

14. The system as recited in claim 13, wherein said printing device is non-operational when electrical power is unavailable.

15. The system as recited in claim 13, said printing fluid delivery system further comprising:

a pump fluidically coupled to said printing fluid port and configured to selectively pump said printing fluid from said container through said printing fluid port when said printing device is operational, and wherein said valve is configured in a bypass position with regard to said pump.

16. The system as recited in claim 15, wherein said pump is further configured to selectively pump said printing fluid into said container through said printing fluid port when said printing device is operational.

17. The system as recited in claim 15, said printing device further comprising:

a printhead fluidically coupled to said pump and receptive of said printing fluid there from.

18. The system as recited in claim 13, said printing device further comprising:

a printhead fluidically coupled to said valve and receptive of said printing fluid there from.

19. A method comprising separating a first volume of gas from a second volume of gas with an interface having a bubbler member that is fluidically wetted with a fluid via capillary action; and configuring said bubbler member to allow a gas from said first volume of gas to pass through said fluid into said second volume of gas when a pressure difference between said first and second volumes of gas reaches a first threshold level, and configuring said bubbler member to allow a gas from said second volume of gas to pass through said fluid into said first volume of gas when said pressure difference between said first and second volumes of gas reaches a second threshold level, wherein said interface includes an opening and said bubbler member includes a filter covering said opening.

20. The method as recited in claim 19, wherein said bubbler member includes a first surface and a second surface arranged to form a gap opening there between.

21. The method as recited in claim 19, said fluid comprising an oil.

22. A method comprising:

separating first volume of gas from a second volume of gas with an interface having a bubbler member that is fluidically wetted with a fluid via capillary action; and configuring said bubbler member to allow a gas from said first volume of gas to pass through said fluid into said second volume of gas when a pressure difference between said first and second volumes of gas reaches a first threshold level, and configuring said bubbler member to allow a gas from said second volume of gas to pass through said fluid into said first volume of gas when said pressure difference between said first and second volumes of gas reaches a second threshold level, wherein said interface includes an opening with an edge, said bubbler member has a surface opposing said edge, and said fluid forms a meniscus between said edge and said surface, wherein at least a portion of said surface is non-planer.

23. The method as recited in claim 22, wherein said interface includes a passageway leading to said edge, said passageway being configured to supply said fluid to said edge and said surface.

24. The method as recited in claim 22, wherein said portion of said surface has a spherical shape.

* * * * *

UNITED STATES PATENT AND TRADEMARK OFFICE

CERTIFICATE OF CORRECTION

PATENT NO. : 7,506,971 B2
APPLICATION NO. : 11/261681
DATED : March 24, 2009
INVENTOR(S) : William E Lewey et al.

It is certified that error appears in the above-identified patent and that said Letters Patent is hereby corrected as shown below:

In column 6, line 17, delete "FIG. 67" and insert -- FIG. 7B --, therefor.

In column 7, line 49, in Claim 10, after "passageway" insert -- leading to said edge, said passageway --.

In column 7, line 52, in Claim 11, delete "surface." and insert -- surface --, therefor.

In column 8, line 36, in Claim 19, delete "comprising" and insert -- comprising: --, therefor.

In column 8, line 58, in Claim 22, after "separating" insert -- a --.

Signed and Sealed this

Eighteenth Day of August, 2009

David J. Kappos

David J. Kappos
*Director of the United States Patent and Trademark Office*